United States Patent [19]

Calhoun et al.

[11] 4,435,084

[45] Mar. 6, 1984

[54] AUTOMATIC STIRRER FOR CUP

[76] Inventors: Tom L. Calhoun; Bill L. Calhoun, both of P. O. Box 447, Buttonwillow, Calif. 93206

[21] Appl. No.: 452,019

[22] Filed: Dec. 21, 1982

[51] Int. Cl.[3] ..... B01F 7/18

[52] U.S. Cl. ..... 366/130; 366/314

[58] Field of Search ..... 366/129, 130, 205, 244, 366/247, 249, 272, 279, 314

[56] References Cited

U.S. PATENT DOCUMENTS

| | | | |
|---|---|---|---|
| 1,488,775 | 4/1924 | Ball | 366/130 |
| 3,054,565 | 9/1962 | Willems | 366/314 |
| 3,263,969 | 8/1966 | Franck, Sr. | 366/314 |
| 3,456,276 | 7/1969 | Spohr | 366/129 |
| 3,533,715 | 10/1970 | Gross | 366/129 |
| 4,149,271 | 4/1979 | Vibel et al. | 366/314 |

*Primary Examiner*—Robert W. Jenkins
*Assistant Examiner*—Arthur D. Dahlberg
*Attorney, Agent, or Firm*—Harvey B. Jacobson

[57] ABSTRACT

An upwardly opening receptacle is provided including upstanding peripherally extending sides and the receptacle is closed at its lower end portion by a false bottom wall extending between and sealed relative to the sides above the lower ends thereof. The receptacle sides extend downwardly below the false bottom wall and define a downwardly opening recess therebelow bound by the lower end portions of the sides. The false bottom has a central upstanding bore formed therethrough and an upstanding shaft is sealingly journaled through the bore and includes blade structure carried by the upper end thereof closely overlying the false bottom wall. Bearing structure is supported from the lower end portions of the sides which extend below the false bottom wall and the lower end of the shaft is guidingly engaged with the bearing structure. In addition, the lower end portion of the shaft includes structure operative to receive rotary torque input.

6 Claims, 10 Drawing Figures

AUTOMATIC STIRRER FOR CUP

BACKGROUND OF THE INVENTION

Many persons who drink hot beverages such as tea and coffee utilize a sweetener and/or cream or milk therewith and in many instances hot beverages such as tea and coffee are provided in an environment where the hot beverage, without a sweetener or cream or milk, is supplied from a large container and the sweetener and/or cream or milk subsequently must be added by a person filling a cut with the hot beverage from the container.

If stirring sticks are used to accomplish the stirring or mixing process other means must be provided for measuring the creamer and/or sweetener used and if a teaspoon or the like is provided for measuring purposes many persons will use the same teaspoon to effect the subsequently desired stirring operation. This results in the teaspoon being wetted and a subsequent attempt to add sweetener such as sugar from a bowl of sugar to a hot beverage by the next beverage consumer results in moisture being transferred to the sugar from the teaspoon causing lumps of sugar to form in the sugar container and the teaspoon to be coated with sugar to thereby render it difficult to accurately measure the desired amount of sugar.

Accordingly, a need exists for structure by which a cup or container of beverage may be stirred without requiring the use of a stirring stick or a teaspoon or the like. With a view toward this end, various forms of containers previously have been provided with means within the lower portions thereof for effecting a stirring action on the contents of the containers. Examples of containers provided with structures within the lower portions thereof for stirring the contents of the containers are disclosed in U.S. Pat. Nos. 1,445,867, 2,459,498, 2,664,002, 2,737,373, 2,924,349, 2,965,274 and 3,285,584.

However, these prior known structures are not particularly well adapted for use in conjunction with a tea or coffee cup or container, or they are not constructed in a manner whereby a stirring operation may be readily effected. Therefore, a need exists for an improved form of beverage cup or container including structure whereby the beverage therein may be stirred.

BRIEF DESCRIPTION OF THE INVENTION

The cup of the instant invention includes upstanding peripheral sides and is closed at its lower end by a false bottom wall extending between and sealed relative to the sides above the lower ends thereof. A downwardly opening recess is defined below the false bottom wall and the latter has a central upstanding bore formed therethrough. An upstanding shaft is sealingly journaled through the bore and includes blade structure carried by the upper end of the shaft closely overlying the false bottom wall. The lower end portions of the sides define bearing structure spaced below the false bottom wall with which the lower end portion of the shaft is guidingly engaged and the lower shaft end portion includes structure thereon by which rotary torque may be applied to the shaft.

In a first form of the invention, the bearing structure is carried by a bottom wall spaced below the false bottom wall and extending between the lower end portions of the sides and an electric motor is supported between the bottom wall and the false bottom wall and is drivingly coupled to the lower end of the shaft. The motor is battery operated by a battery also disposed between the bottom wall and the false bottom wall and the battery is electrically connected to the motor by circuitry including an actuating switch serially connected therein and operable from an external portion of the receptacle or cup. The bearing structure for the lower end of the shaft is supported from the bottom wall.

In a second form of the invention the lower bearing structure is defined by a circumferentially extending inwardly opening groove defined by the lower end portions of the side walls and the lower end portion of the shaft includes a disc whose peripheral portions are guidingly received in the groove. In addition, the disc has an eccentric opening therein into which the free end of a digit may be inserted for applying manual torque to the shaft.

The main object of this invention is to provide a cup for hot beverages such as coffee or tea and including structure by which the hot beverage may be stirred after the addition of a sweetener or creamer to the beverage.

Another object of this invention is to provide a cup in accordance with the preceding object and wherein the stirring mechanism is driven by a miniature battery powered motor.

A further object of this invention is to provide a cup including a stirring mechanism and wherein the stirring mechanism is adapted to be manually powered from the lower end of the cup.

Another object of this invention is to provide a cup including a stirring mechanism and wherein the cup may be of the reusable type or of the disposable type.

A final object of this invention to be specifically enumerated herein is to provide a cup in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
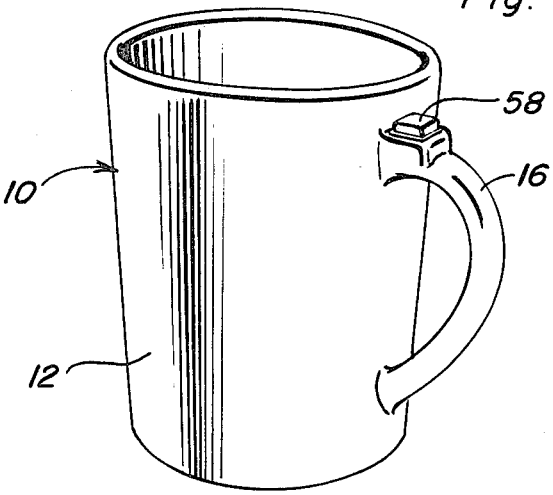
FIG. 1 is a perspective view of a first form of cup constructed in accordance with the present invention.
Figure 2:
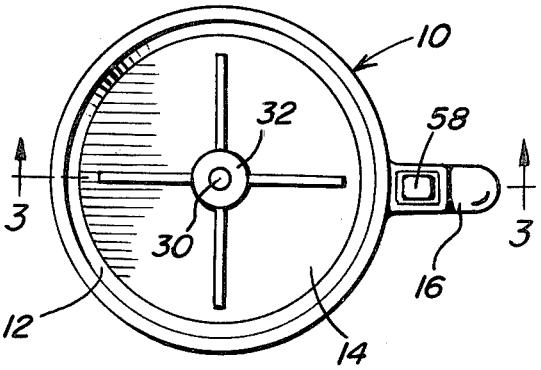
FIG. 2 is a top plan view of the cup illustrated in FIG. 1.
Figure 3:
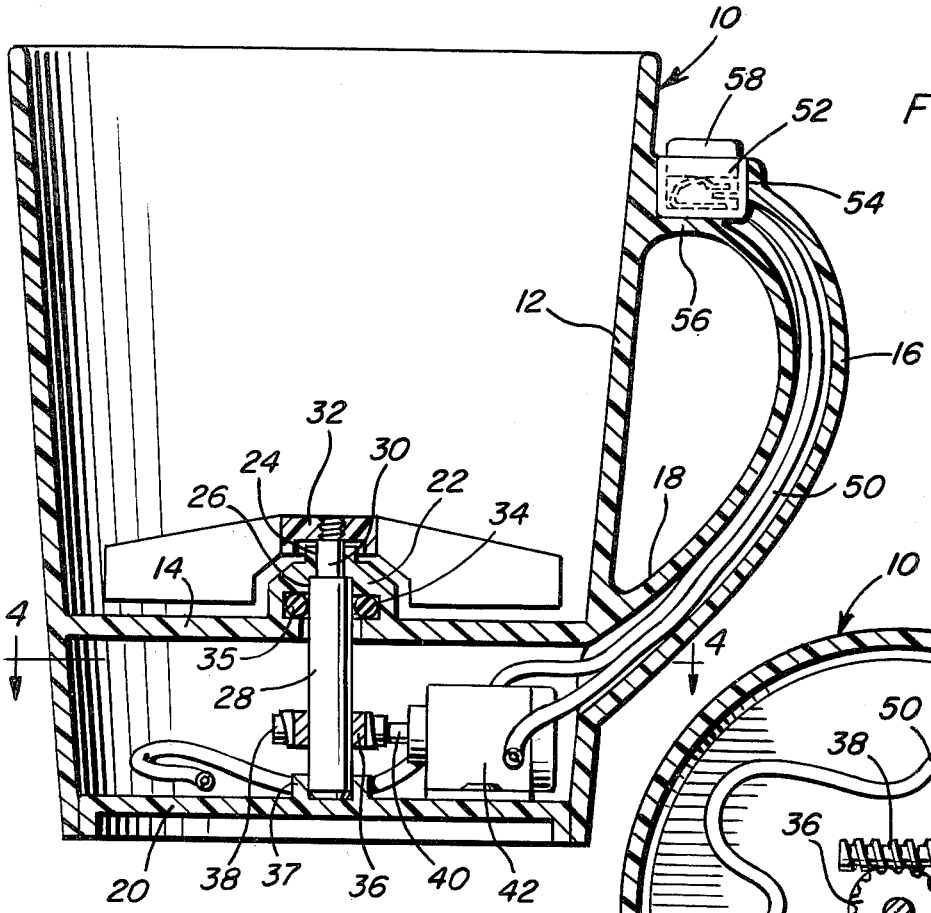
FIG. 3 is an enlarged vertical sectional view taken substantially upon the plane indicated by the section line 3—3 of FIG. 2.
Figure 4:
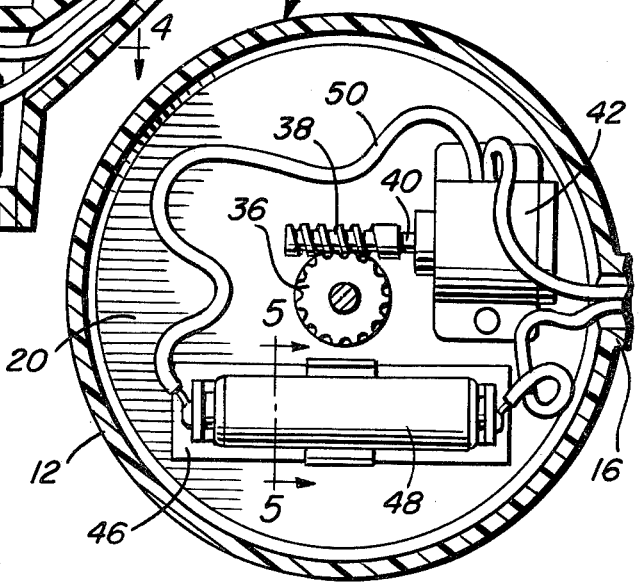
FIG. 4 is a horizontal sectional view taken substantially upon the plane indicated by the section line 4—4 of FIG. 3.
Figure 5:
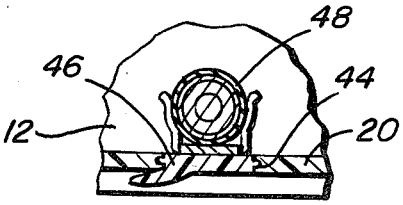
FIG. 5 is a fragmentary vertical sectional view taken substantially upon the plane indicated by the section line 5—5 of FIG. 4.

Referring now more specifically to the drawings, the numeral 10 generally designates a first form of cup or receptacle constructed in accordance with the present invention. The cup 10 includes an upstanding peripherally extending side wall 12 and a false bottom wall 14 sealingly secured across the lower end of the cup 10 a spaced distance above the lower end of the side wall 12. A tubular handle 16 is integrally formed with one marginal portion of the side wall 12 and includes a lower end portion 18 which opens inwardly through the side wall 12 immediately below the false bottom wall 14. A bottom wall 20 is secured across the lower end portion of the cup 10 a spaced distance below the false bottom wall 14 and the central portion of the false bottom wall 14 includes an upwardly projecting central boss 22 having an upstanding bore 24 formed therethrough, the bore 24 including a lower end diametrically enlarged counterbore 26.

An upstanding shaft 28 includes a diametrically reduced upper end portion 30 and is journaled in the bore 24 and the counterbore 26. The upper terminal end of the shaft 28 is threaded and has a blade assembly 32 removably threadedly engaged thereon. The blade assembly 32 closely overlies the upper surface of the false bottom wall 14.

The upwardly projecting portion or boss 22 includes an inwardly opening peripheral groove 34 in which a sealing ring 35 is received and the lower end of the shaft 28 is journaled in a bearing journal 37 carried by and projecting upwardly from the central portion of the bottom wall 20. The shaft 28 is a worm wheel 36 mounted thereon and a worm gear 38 carried by the output shaft 40 of a miniature electric motor 42 is meshed with the worm wheel 36. The motor 42 is mounted on the upper surface of the bottom wall 20 and the bottom wall 20 has an opening 44 formed therein closed by a removable portion 46 from which a replaceable battery 48 is supported. The battery 48 is electrically connected to the motor 42 by wiring 50 having a push-button switch 52 serially connected therein. The push-button switch 52 is secured in a recess 54 provided therefor in the upper end portion 56 of the handle 16 and those portions of the wiring 50 extending to and away from the switch 52 pass through the hollow interior of the handle 16.

In operation, a beverage may be received within the cup or container 10 and a sweetener and/or creamer may be added to the beverage. Thereafter, the push-button 58 of the switch may be momentarily depressed in order to actuate the motor 52 and cause the blade assembly 32 to be rotated immediately above the false bottom wall 14 and to thereby stir the contents of the cup or container 10.

Figure 6:
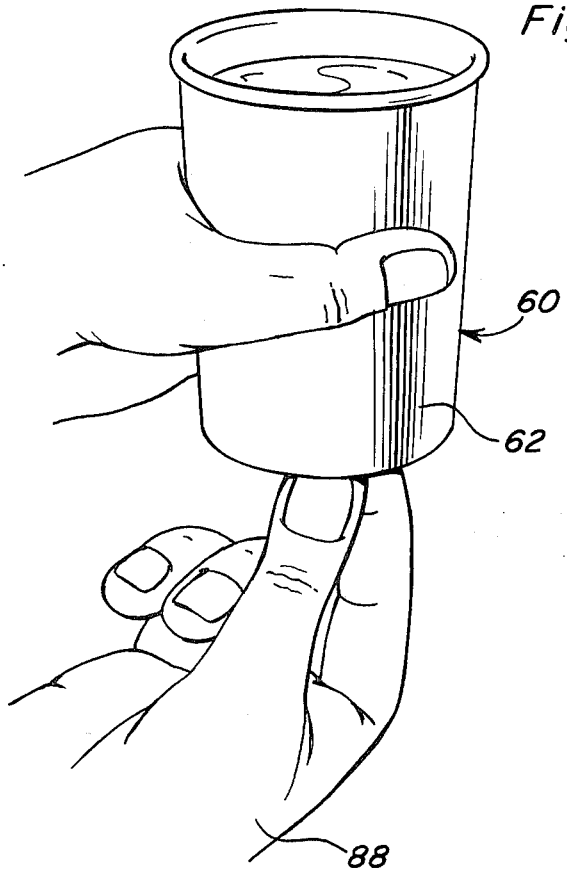
FIG. 6 a perspective view of a second form of the invention.
Figure 7:
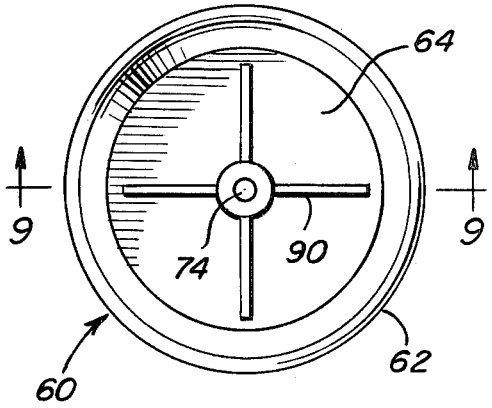
FIG. 7 is a top plan view of the second form of the invention.
Figure 8:
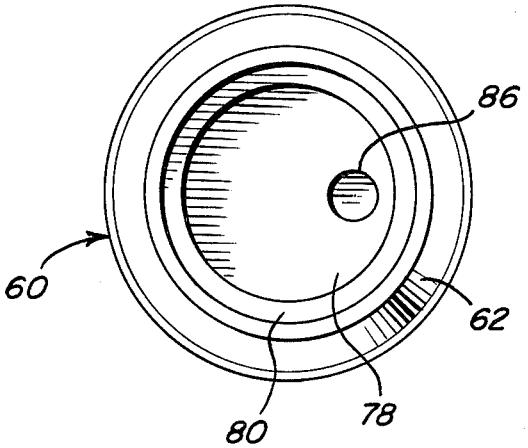
FIG. 8 is a bottom plan view of the second form of the invention.
Figure 9:
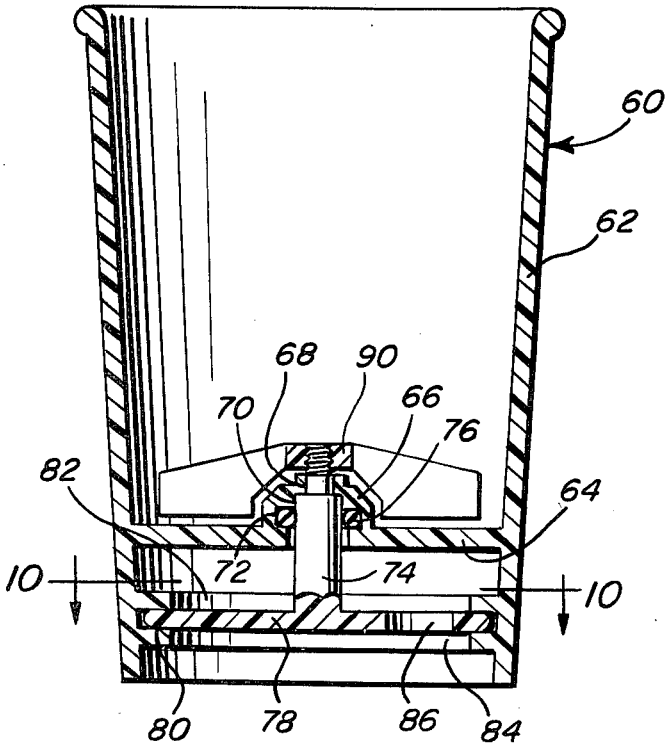
FIG. 9 is an enlarged vertical sectional view taken substantially upon the plane indicated by the section line 9—9 of FIG. 7.
Figure 10:
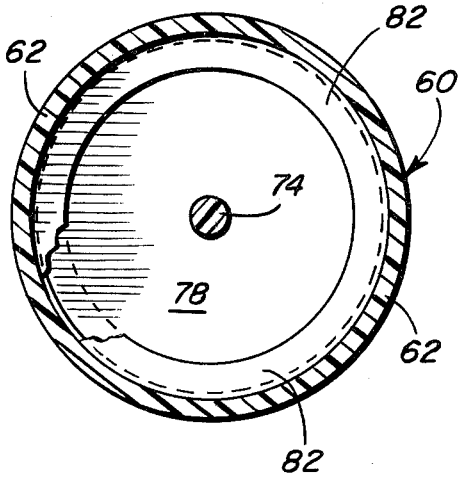
FIG. 10 is a horizontal sectional view taken substantially upon the plane indicated by the section line 10—10 of FIG. 9.

With attention now invited more specifically to FIGS. 6 through 10 of the drawings, there may be seen a modified form of cup referred to in general by the reference numeral 60. The cup 60 includes an upstanding peripheral side wall 62 and a false bottom wall 64 sealingly secured across the lower end portion of a cup 60 at a level spaced above the lower end of the side wall 62. The false bottom wall 64 includes an upwardly projecting boss 66 corresponding to the boss 22 and upwardly through which a vertical bore 68 extends, the bore 68 including a lower end diametrically enlarged counterbore 70 and defining an inwardly opening peripheral groove 72. A shaft 74 including a diametrically reduced upper end is journaled in the bore 68 and counterbore 70 and a sealing ring 76 is received in the groove 72 and forms a fluid tight seal with the shaft 74.

The lower end portion of the shaft 74 is provided with a circular disc 78 and the outer periphery of the disc 78 is guidingly received within a circumferential inwardly opening groove 80 defined by the lower end portion of the side wall 62 spaced below the false bottom wall 64. The groove 80 is defined between a pair of vertically spaced circumferentially extending and inwardly projecting ribs 82 and 84 carried by the side wall 62, but each of the ribs 82 and 84 could be appreciably abbreviated so as to be formed by as few as two or three inwardly projecting and circumferentially extending lugs.

The disc 78 has an eccentrically disposed opening 86 formed therethrough and the opening 86 is adapted to seatingly receive the free end of a digit of the hand 88 of the user of the cup 60. In this manner, rotary input torque may be applied to the shaft 74 in order to cause the blade assembly removably mounted on the upper end of the shaft 74 closely above the false bottom wall 64 to rotate within the lower portion of the interior of the cup 60.

By utilizing a cup constructed of expanded plastic material the cup 60 may be considered as disposable. Further, the stirring mechanism comprising the shaft 74, disc 78 and blade assembly 90 may also be disposable, or these components may be of the non-throw away type with the blade assembly 90 removably supported from the upper end of the shaft 74 and transferrable from one throw away type of expanded plastic cup to another, as desired. In this instance, the ribs 82 and 84 probably will be abbreviated as hereinabove discussed whereby the flexibility of the cup will enable the disc 78 to be received in the groove 80.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A beverage cup defining an upwardly opening receptacle including upstanding peripherally extending sides and closed at its lower end portion by a false bottom wall extending between and sealed relative to said sides above the lower ends thereof, said receptacle sides extending downwardly below said false bottom wall and defining a downwardly opening recess therebelow bound by the lower end portions of said sides, said false bottom wall having a central upstanding bore formed therethrough, an upstanding shaft sealingly journaled through said bore and including blade means carried by the upper end thereof and closely overlying said false bottom wall, bearing means supported from the lower end portions of said sides below said false bottom wall and with which the lower portion of said shaft spaced below said false bottom wall is guidingly engaged, said lower portion of said shaft including means operative to allow rotary torque input to said shaft, said bearing means including a bottom wall secured between the lower end portions of said sides below said false bottom wall, a central portion of said bottom wall including a bearing journal in which said lower portion of said shaft is journaled, said means operative to allow rotary torque input to said shaft comprising a worm wheel mounted on said shaft, a miniature electric motor mounted on one of said walls between the latter and having a rotary output shaft equipped with a worm gear meshed with said worm wheel, a battery supported between said false bottom wall and said bottom wall and electrically connected to said motor by circuitry having a manually operable control switch serially connected therein, a laterally offset upstanding tubular handle having an upper end directed inwardly toward, formed integrally with and closed by one peripheral portion of an upper portion of the side wall of said cup and its lower end opening through a lower portion of said cup side wall between said bottom wall and said false bottom wall, said switch being recessed in said upper end of said handle and said circuitry including portions thereof electrically connecting said battery to said motor and extending through the hollow interior of said handle.

2. The cup of claim 1 wherein said bottom wall includes an opening formed therethrough in which a closure for said opening is removably mounted, said battery being movably supported from said closure.

3. A cup defining an upwardly opening receptacle including upstanding peripherally extending sides and closed at its lower end portion by a false bottom wall extending between and sealed relative to said sides above the lower ends thereof, said receptacle sides extending downwardly below said false bottom wall and defining a downwardly opening recess therebelow bound by the lower end portions of said sides, said false bottom wall having a central upstanding bore formed therethrough, an upstanding shaft sealingly journaled through said bore and including blade means carried by the upper end thereof and closely overlying said false bottom wall, bearing means supported from the lower end portions of said sides below said false bottom wall and with which the lower portion of said shaft spaced below said false bottom wall is guidingly engaged, said lower portion of said shaft including means operative to allow rotary torque input to said shaft, the lower portion of said shaft including a circular disc, the portions of said side wall disposed below said false bottom wall defining an inwardly opening peripherally extending groove in which the outer periphery of said disc is guidingly received, said disc including eccentrically located means for manually applying rotary torque thereto.

4. The cup of claim 3 wherein the last mentioned means includes an eccentrically disposed opening formed through said disc and adapted to have the free end of the digit of the hand seatingly receive therein.

5. The combination of claim 3 wherein the blade means is removably supported from the upper end of said shaft.

6. The combination of claim 3 wherein said groove is defined by and between a pair of upper a lower peripherally extending inwardly projecting ribs carried by the lower portion of said side wall spaced below said false bottom wall.

* * * * *